United States Patent [19]

Alklind et al.

[11] Patent Number: 4,697,290

[45] Date of Patent: Oct. 6, 1987

[54] DEVICE COMPRISING A MATTRESS SUPPORT

[75] Inventors: Lars E. Alklind, Hagfors; Eric Nilsson, Kungsängen, both of Sweden

[73] Assignee: Regionala Stiftelsen i Varmland med firma Erress, Hagfors, Sweden

[21] Appl. No.: 862,251

[22] Filed: May 12, 1986

[51] Int. Cl.[4] ..... A47C 27/10

[52] U.S. Cl. ..... 5/61; 5/66; 5/455

[58] Field of Search ..... 5/455, 508, 60, 61, 5/66, 453, 81 R, 62, 68

[56] References Cited

U.S. PATENT DOCUMENTS

| | | | |
|---|---|---|---|
| 2,731,652 | 1/1956 | Bishop | 5/455 |
| 3,392,723 | 7/1968 | Calvin | 5/60 |
| 3,477,071 | 11/1969 | Emerson | 5/61 |
| 3,485,240 | 12/1969 | Fountain | 5/61 |
| 3,775,781 | 12/1973 | Bruno | 5/61 |
| 3,879,772 | 4/1975 | Pol | 5/62 |
| 4,287,620 | 9/1981 | Zur | 5/62 |
| 4,459,714 | 7/1984 | Lin | 5/455 |
| 4,525,885 | 7/1985 | Hunt | 5/66 |
| 4,528,704 | 7/1985 | Wegener | 5/81 R |

FOREIGN PATENT DOCUMENTS

| | | | |
|---|---|---|---|
| 2408784 | 8/1975 | Fed. Rep. of Germany | 5/61 |
| AD61859 | 5/1955 | France | 5/455 |
| 194258 | 6/1967 | U.S.S.R. | 5/453 |

*Primary Examiner*—John E. Murtagh

*Attorney, Agent, or Firm*—Murray and Whisenhunt

[57] ABSTRACT

The invention relates to a device comprising a mattress support intended to be placed underneath a mattress or the like, to facilitate the care of bedridden patients. The support consists of a number of sections (1), each comprising a rigid board (4) or the like, extending essentially fully across the width of the support, and underneath each such board at least two inflatable cells (13*a*, 13*b*), of which at least one is placed on each side of an imaginary center line (14) along the support (21). The sections are adjoining along their adjacent edges (2), said joint being articulate and/or permitting the disassembly and reassembly of the support, and the inflatable cells on each side of said center line are inflatable independently and optionally, thus providing for a slow rocking of a patient lying on the bed, via the rigid boards and the mattress (23) on top of the support, thereby causing a redistribution of the areas of pressure between the mattress and the patient which in turn counteracts the formation of bed sores and/or provides a certain massaging effect.

5 Claims, 8 Drawing Figures

Fig. 3.
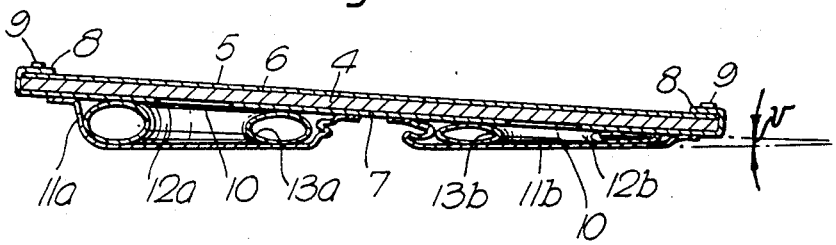
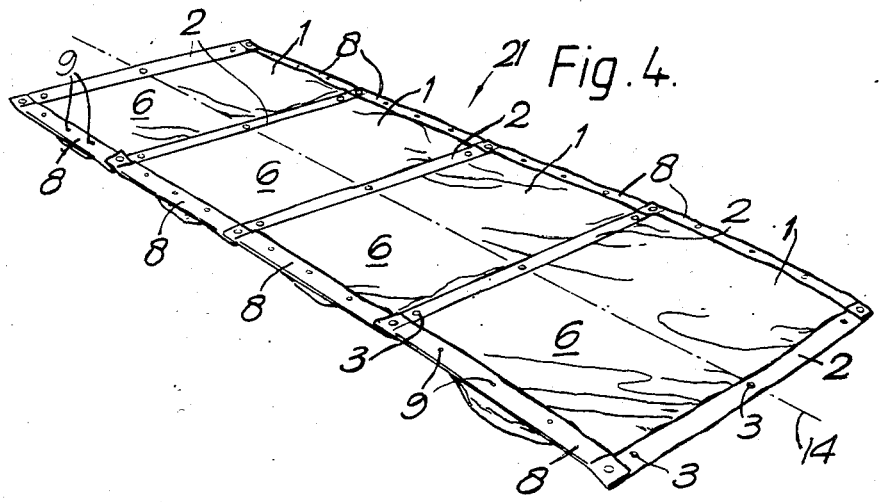
Fig. 4.
Fig. 5.
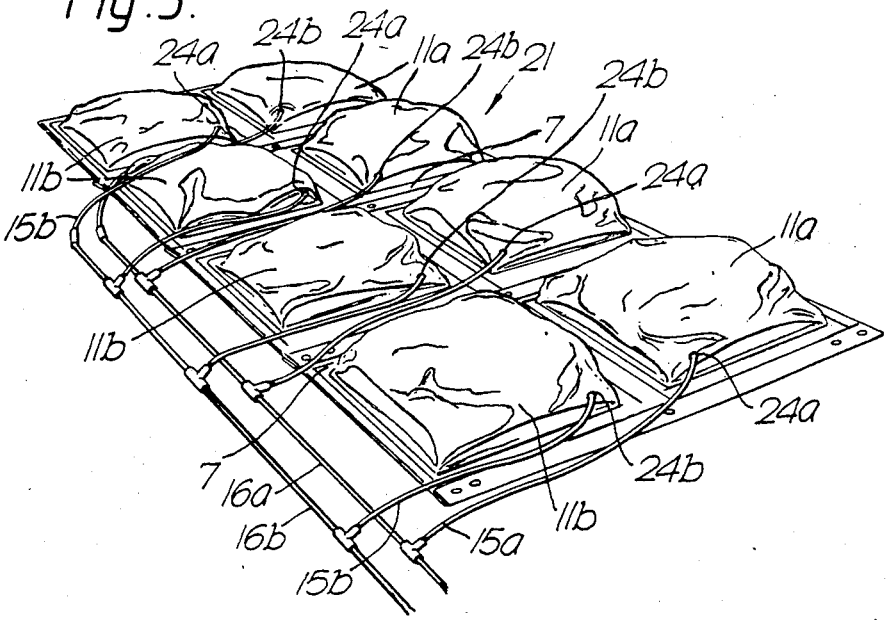

DEVICE COMPRISING A MATTRESS SUPPORT

TECHNICAL SCOPE

This invention relates to a device comprising a mattress support to be placed underneath a mattress or the equivalent thereof to facilitate the care of bedridden patients. In particular, the invention relates to a device intended to redistribute the areas of pressure between the patient's skin and the mattress, thereby preventing the occurrence of bed sores and/or providing a certain massaging effect.

BACKGROUND ART

The difficulty of preventing the occurrence of bed sores in the treatment of bedridden patients is a major problem, especially in the care of long time bed patients. This is true both for hospital and—especially—for home care. A number of different methods and aids have been used to prevent bed sores and to treat them. Generally, known methods are based on the even distribution of body weight and especially on the relief of pressure at those areas of the body where the patient's bone structure normally gives rise to increased pressure, and/or on the more or less regular redistribution of such areas. Existing aids include soft special beds, water beds, and hospital beds which slowly rock the patient. The rocking bed may also provide a certain amount of massage, which at times is also desirable. A drawback and a limitation of these known devices, however, is that they for a number of reasons are difficult to use within the home care sector. For example, they are expensive, difficult to transport, difficult to install in a home, and generally require to be handled by trained personnel.

Devices of the mattress type comprising inflatable cells are also long known. Such devices are presented in SE No. 322 312, SE No. 351 130, SE No. 409 653, U.S. Pat. No. 2,859,505, U.S. Pat. No. 3,492,988, and U.S. Pat. No. 3,477,071. These known devices are primarily designed to be useful when a patient is to be turned from side to side, and are generally impractical as an aid within the field of home care, there to prevent bed sores and/or to provide some massaging effect.

DISCLOSURE OF INVENTION

The object of the invention is to solve the problems listed above. To this end, the invention is characterized in that the mattress support is made up of a number of sections, comprising a rigid board or some corresponding element extending essentially fully across the support, and beneath each such board at least two inflatable cells, one on each side of an imaginary center line along the support, and that the sections are connected to each other by a joint which is articulated and/or permits disassembly and reassembly, and that the inflatable cells on the two sides of the said center line may be inflated independently and optionally, their being inflated, via the rigid boards and the mattress arranged on top of the support, causing a slow rocking of a patient lying on the bed, the redistribution of the areas of pressure thus brought about preventing the occurrence of bed sores, and/or providing said massage. The support preferably consists of at least three, preferably identical, sections.

According to a preferred embodiment, the board in each of the sections is arranged in an envelope comprising at least two deformable spaces or chambers for the inflatable cells. In each of these spaces or chambers there is arranged an inflatable cell, which may be in the form of an annular tube. The envelope may be made of plastic-coated fabric or of some other material which is easy to clean.

Further, the device according to the invention comprises means for the alternate inflating and deflating of the inflatable cells on opposite sides of said center line according to a time-controlled working cycle, thereby effecting the desired rocking movement. The maximum inclination of the boards in the device according to the invention is 10° to the horizontal plane, preferably 7°.

Further characteristics, aspects, and advantages of the invention will become apparent from the appended patent claims and from the following description of a preferred embodiment.

BRIEF DESCRIPTION OF DRAWINGS

In the following description of a preferred embodiment, reference will be made to the attached drawings, wherein

FIG. 3 is a section taken along III—III of FIG. 1;

FIG. 4 is a perspective view of the upper side of the mattress support comprising four sections;

FIG. 5 is a perspective view of the bottom side of the same mattress support;

DESCRIPTION OF A PREFERRED EMBODIMENT

Figure 1:
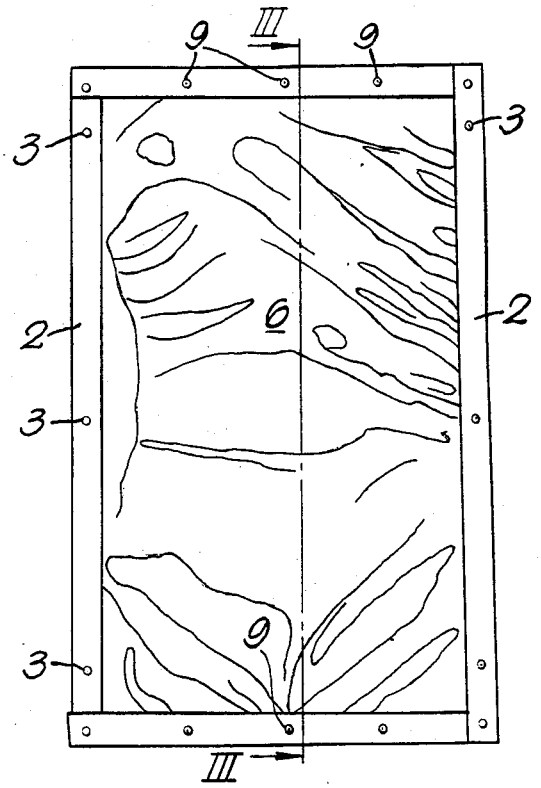
FIG. 1 is a plan sectional view of the mattress support according to the invention.
Figure 2:
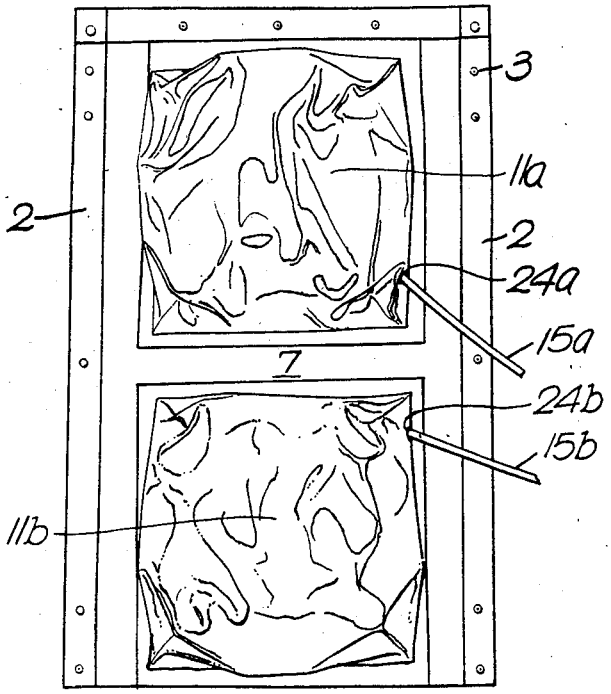
FIG. 2 is a view of the same device from below.
Figure 6:
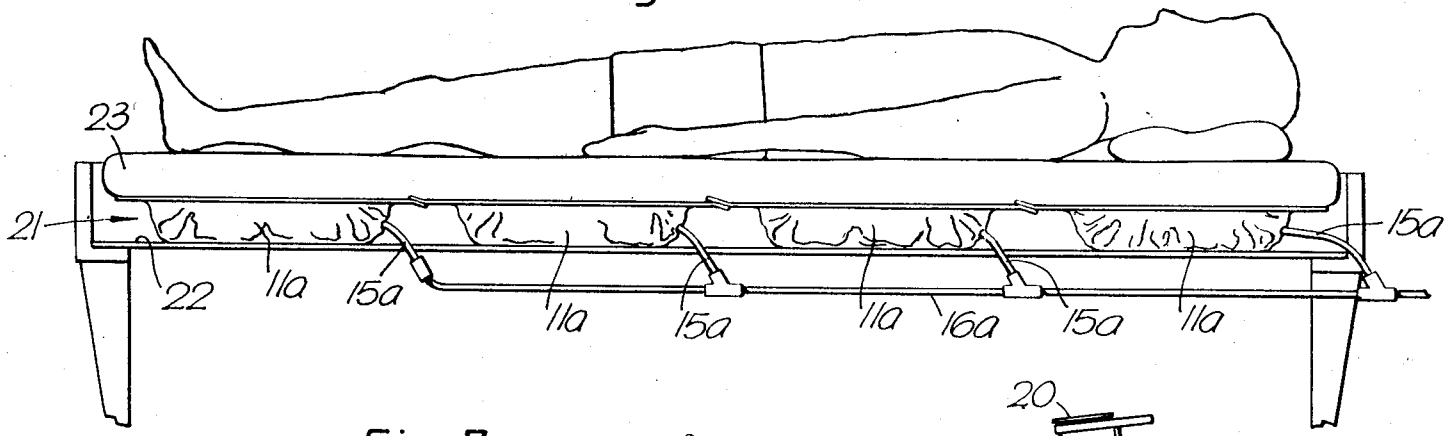
FIG. 6 is a schematic elevation of the long side of a mattress support in use.
Figure 7:
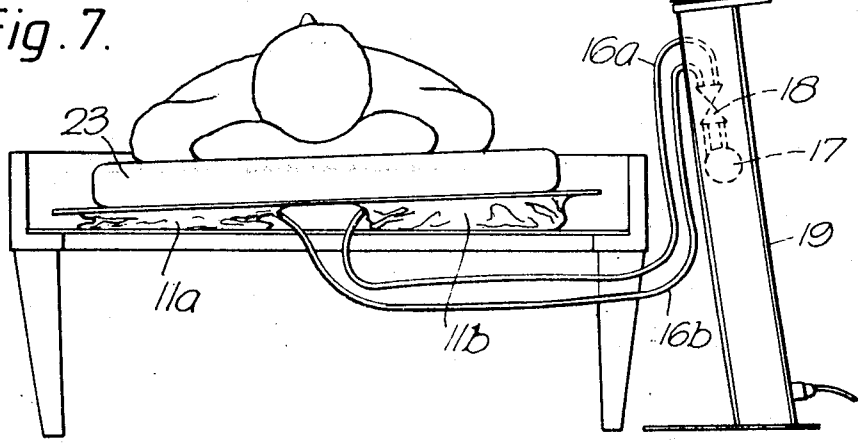
FIG. 7 corresponds to FIG. 6, but is a short side elevation.

The mattress support 21 according to the invention consists of a number of identical sections 1. The sections 1 are rectangular. The edges 2, which form the long sides of the sections 1, are provided with snap fasteners 3. The edge sections 2 of adjacent sections 1 overlap and are joined by the snap fasteners 3, a coherent, flexible mattress support 21 thus being provided, FIG. 4. The mattress support 21 thus put together is essentially as long as a normal bed, while each of the sections 1 extend transversely to the bed, ie in the direction of the edges 2, essentially fully across the bed, and hence the support 21 also covers essentially the whole width of the bed.

The top of each section 1 is flat. This flatness is brought about by a rigid board 4, eg a hard fiber-board. The board 4 is arranged inside an envelope 5 consisting of plastic-coated, water-impermeable fabric. The top side of the envelope is referred to by numeral 6 and its bottom side by numeral 7. The envelope 5 is closed along the two short sides of each section 1, where the envelope extends from below up around the edge with folded edge sections 8, the edge sections being held against the top side 6 by means of snap fasteners 9. By releasing the fasteners 9 the edges 8 may be folded aside, thus giving access to the inside of the envelope 5.

The bottom side 7 of the envelope 5 is provided with two circular holes 10. Under each such hole 10 an essentially square pad 11*a*,11*b* is attached by welding. Each of the pads 11*a* and 11*b* forms a deformable chamber 12*a* and 12*b*. Inside each of the chambers 12*a* and 12*b* there is an inflatable annular tubular cell 13*a* and 13*b*, respectively. Ordinary tire tubes as used in the tires of small hand carts are well suited for this purpose. The inflatable cells 13*a* on the one side of the imagined center line along the mattress support are attached via branch conduits 15*a* to main conduit 16*a* for air. Correspondingly, the cells 13*b* on the other side of said center line are attached via branch conduits 15*b* to a main line 16*b*. The branch conduits 15*a*, 15*b* extend through holes 24*a* and 24*b*, respectively, in the pads 11*a* and 11*b*. The main conduits 16*a* and 16*b* are in turn connected to an air pump 17, symbolically indicated in the drawing, via a two-way valve 18 in an aggregate 19. The valve 18 is time-controlled to alternately fill and evacuate the inflatable cells 13*a* and 13*b*, respectively. One working cycle comprises first the filling of the inflatable cells 13*a* on the one side of the center line 14 concurrently with the evacuation of the cells 13*b* on the other side thereof, followed by the evacuation of the former cells 13*a* and the filling of the latter cells 13*b* with air from the air pump 17. The duration of such a cycle may be adjusted to from 2 to 10 minutes. A time-setting mechanism for the adjustment of the cycle interval has been designated 20 and is at the same time a power switch for the air pump 17.

The mattress support 21 according to the invention is placed on a bed structure 22 underneath a mattress 23, the flat side of the support 21, FIG. 4, facing the mattress 23 and the pads 11*a*, 11*b* facing the bed frame 22. By inflating the cells 13*a* in the pads 11*a* and simultaneously evacuating the cells 13*b* in the pads 11*b*, the rigid boards 4 and hence the mattress 23 are made to incline at an angle v to the horizontal plane, FIG. 3. To achieve the desired redistribution of the patient's body weight as the patient is lying on the mattress 23 thereby preventing bed sores and/or providing a certain massage therapy, the angle of inclination v should not exceed 10°, preferably not 7°. The inflatable cells 13*a* thus having been filled and the cells 13*b* evacuated, the valve 18 reciprocates, thus causing the cells 13*b* to be filled and the cells 13*a* evacuated and hence making the board 4 incline in the other direction by the same angle v. By making the air circulate inside the system, no disturbing hiss is created, and generally, the system is extremely quiet.

Figure 8:
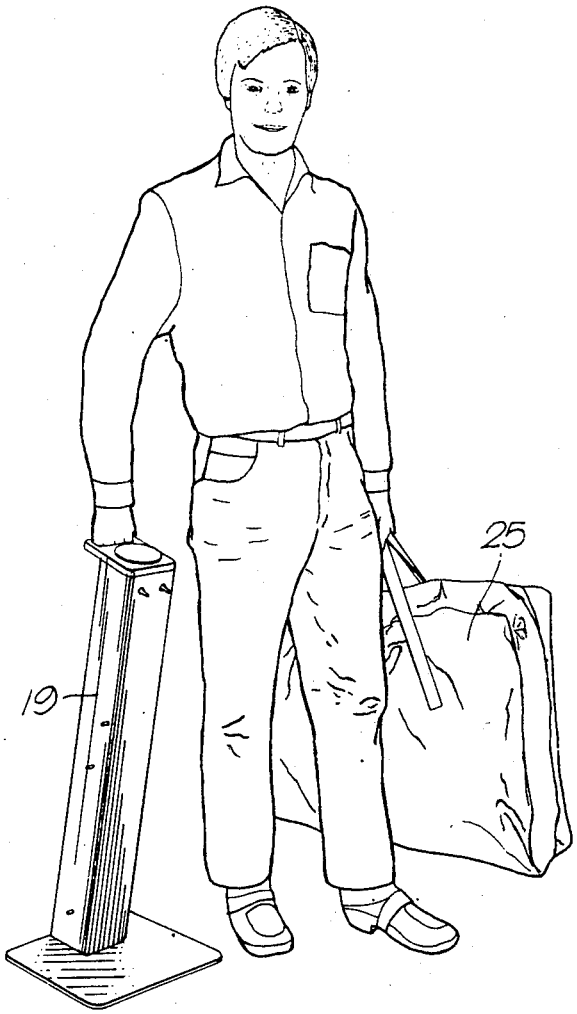
FIG. 8 shows the device during transport.

When the device is to be moved some considerable distance, such as from one patient's home to that of another, the mattress support 21 is folded into a parcel by folding along the edges 2. The sections 1 thus brought together by folding and the attached air hoses may then be put into a portable case 25. The aggregate 19 is also portable, as is illustrated in FIG. 8.

What is claimed is:

1. A device to facilitate the care of bed patients comprising a support structure to be placed underneath a mattress having a first longitudinal center line, a predetermined length and a predetermined width; said support structure comprising at least three sequentially connected identical sections; each of said sections comprising a rigid, substantially rectangular, planar member having a width substantially equal to said predetermined width of said mattress, a first pair of opposed widthwise edges, a top planar surface, supportingly receivable of said mattress, disposed between said first pair of widthwise edges, a bottom planar surface disposed between said first pair of widthwise edges and a second longitudinal center line alignable with said first longitudinal center line, an envelope releasably enclosing said planar member, said envelope including a second pair of widthwise edges corresponding to said first pair of widthwise edges and at least two deformable chambers contacting said bottom planar surface of said planar member, at least one of said deformable chambers located on each side of said second longitudinal center line, connection means, located on said second pair of widthwise edges, for releasably articulatably connecting adjacent sections along their respective adjacent widthwise edges, at least one independently inflatable cell, disposed in each of said deformable chambers, for deforming said chambers away from said bottom planar surface to incline said planar member in the transverse direction, wherein said inflatable cells may independently deform said deformable chambers to produce a maximum inclination of said planar member to a horizontal plane of 10 degrees.

2. The device according to claim 1, wherein said independently inflatable cell comprises an annular tube.

3. The device according to claim 1, wherein said envelope consists of a liquid-impermeable material.

4. The device according to claim 3, wherein said liquid-impermeable material comprises plastic-coated fabric.

5. The device according to claim 1, further comprising pump means for generating compressed air to inflate said at least one independently inflatable cell;

valve means, operably connected to said pump means and said at least one independently inflatable cell, for selectively supplying compressed air from said pump means to said inflatable cells in said deformable chamber on one side of said second longitudinal center line and releasing compressed air from said inflatable cells in said deformable chambers on the other side of said second longitudinal center line in a first valve position and vice-versa in a second valve position; and timing means, operably connected to said valve means, for cyclically switching said valve between said first valve position and said second valve position;

whereby said mattress is rocked in said transverse direction.

* * * * *